US006581870B1

(12) United States Patent
Runne et al.

(10) Patent No.: US 6,581,870 B1
(45) Date of Patent: Jun. 24, 2003

(54) METHOD AND APPARATUS FOR REDUCING PRESSURE AND TEMPERATURE ON THE FRONT OF A MISSILE AT ULTRASONIC SPEED

(75) Inventors: Kay Runne, Friedrichshafen (DE); Julio Srulijes, Binzen (DE)

(73) Assignee: LFK Lenkflugkoerpersysteme GmbH, Munich (DE)

( * ) Notice: Subject to any disclaimer, the term of this patent is extended or adjusted under 35 U.S.C. 154(b) by 0 days.

(21) Appl. No.: 09/707,915

(22) Filed: Nov. 8, 2000

(30) Foreign Application Priority Data

Nov. 8, 1999 (DE) ..... 199 53 701

(51) Int. Cl.[7] ..... B64C 1/38
(52) U.S. Cl. ..... 244/1 N; 244/3.1; 244/130
(58) Field of Search ..... 244/1 R, 1 N, 244/1 A, 117 R, 119, 130, 121

(56) References Cited

U.S. PATENT DOCUMENTS 2,980,370 A * 4/1961 Takacs ..... 244/1 N
3,424,400 A * 1/1969 Le Bel ..... 244/1 N
3,425,650 A * 2/1969 Silva ..... 244/130
3,497,163 A * 2/1970 Wakefield ..... 244/15
3,643,901 A * 2/1972 Patapis ..... 244/1 N
4,650,139 A * 3/1987 Taylor et al. ..... 244/1 N

FOREIGN PATENT DOCUMENTS

DE 38 07 725 A1 3/1988

OTHER PUBLICATIONS

AIAA 95–0737—"Experimental Results on the Feasibility of an Aerospike for Hypersonic Missiles" Lawrence D. Huebner, Anthony M. Mitchell and Ellis J. Boudreaux; Jan. 9–12, 1995; Reno, NV pps. title page—11.

* cited by examiner

*Primary Examiner*—Galen L. Barefoot
(74) *Attorney, Agent, or Firm*—Crowell & Moring LLP

(57) ABSTRACT

In a method and apparatus for reducing pressure and temperature on the front of a missile at ultrasonic speed a spike with a spherical, ellipsoidal, or drop-shaped mounted is used on the front end. In contrast to conventional shapes, the sensitive nose of the missile is protected from damaging pressure and temperature, even at high angles of incidence.

5 Claims, 3 Drawing Sheets

METHOD AND APPARATUS FOR REDUCING PRESSURE AND TEMPERATURE ON THE FRONT OF A MISSILE AT ULTRASONIC SPEED

BACKGROUND AND SUMMARY OF THE INVENTION

This application claims the priority of German patent document 199 53 701.1, filed Nov. 8, 1999, the disclosure of which is expressly incorporated by reference herein.

The present invention is directed to a method and apparatus for reducing pressure and temperature on the front of a missile at ultrasonic speed.

For 30 years, pressure and temperature have been reduced at the front of missiles at ultrasonic speed with the aid of a rod (spike or aerospike), and numerous publications have addressed this subject. One example is the Lockheed-Martin Trident missile, a long-range rocket that is fired from submarines. In a publication AIAA 95-0737, a plate-shaped mount (aerodisk) is placed on the tip of the aerospike with approximately three-times the diameter of the spike to attain the desired effect at constant spike lengths for a wide range of speed. Until now, however, it has not been possible for such missiles to fly at high ultrasonic speeds or at high Mach numbers at high angles of incidence (approximately 10°) without a very large amount of resistance and without the full ram temperature, which substantially limits the maneuverability of a missile.

One object of the invention is to create an arrangement that protects the sensitive nose of the missile from damaging pressure and temperature not only for a wide range of speed but also for high angles of incidence.

This and other objects and advantages are achieved by the method and apparatus according to the invention, which uses an aerospike with an added spherical, ellipsoid or drop-shaped mount on the front end. The separation of the fluid flow from such a body as well as its surrounding flow in general are independent of the angle of incidence, and hence to a large extent, so is its effect on the following flow around the aerospike and the flow on the front of the missile. Missiles can hence be created that are highly maneuverable at high ultrasonic speeds without high pressures and temperatures arising at the front the resistance and hence the required thrust of such a missile is strongly reduced when the invention is applied, which correspondingly increases the range and flight duration of such a missile.

Other objects, advantages and novel features of the present invention will become apparent from the following detailed description of the invention when considered in conjunction with the accompanying drawings.

DETAILED DESCRIPTION OF THE DRAWINGS

Figure 1:
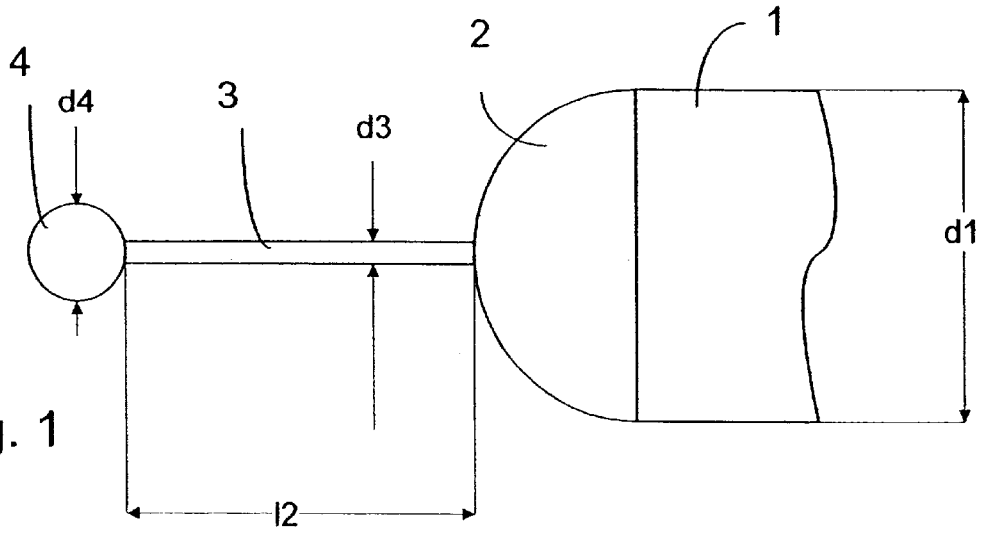
FIG. 1 is a schematic representation of the arrangement according to the invention.

FIG. 1 schematically shows an arrangement according to the invention. A hemispherical nose 2, which is attached to the tip of a missile 1, transitions into an aerospike which consists of a rod 3 and a mount 4 the latter is approximately spherical according to the invention. However, it can also be ellipsoidal or in the shape of a drop as in FIGS. 2 and 2*a*. Design details and the basic mode of operation of a generic aerospike are described, for example, in AIAA 95-0737.

The description of the design according to the invention and its differences from the state of the art are illustrated in the differential interferograms attached as FIGS. 3*a*, 3*b*, 4*a* and 4*b*. Differential Interferometry uses Wollaston prisms. Light beams that are polarized at 45° to the optical axis of the first Wollaston prism, or that possess circular polarization, are split into two coherent partial beams of the same intensity polarized perpendicular to each other. The partial beams pass through the phase object on separate paths and are then joined in a second Wollaston prism and are caused to form interference in the image plane after passing through a polarizer. This method is used to make visible density gradients, i.e., gradients of optical paths in the gas stream. Differential Interferometry is a simple method that can yield quantitatively evaluatable images and belongs to classic optical flow metrology. It is described in the relevant literature and handbooks on optical metrology.

In the arrangements in the figures, the missile has a diameter d1 of approximately 70 mm; the diameter d2 of the spike is approximately 5 mm, and its length 12 is approximately 45 mm. The diameter d4 of the spherical mount is approximately 17.5 mm.

The diameter of the spike is between 50 and 20 percent of the diameter of the additional body.

Figure 3A:
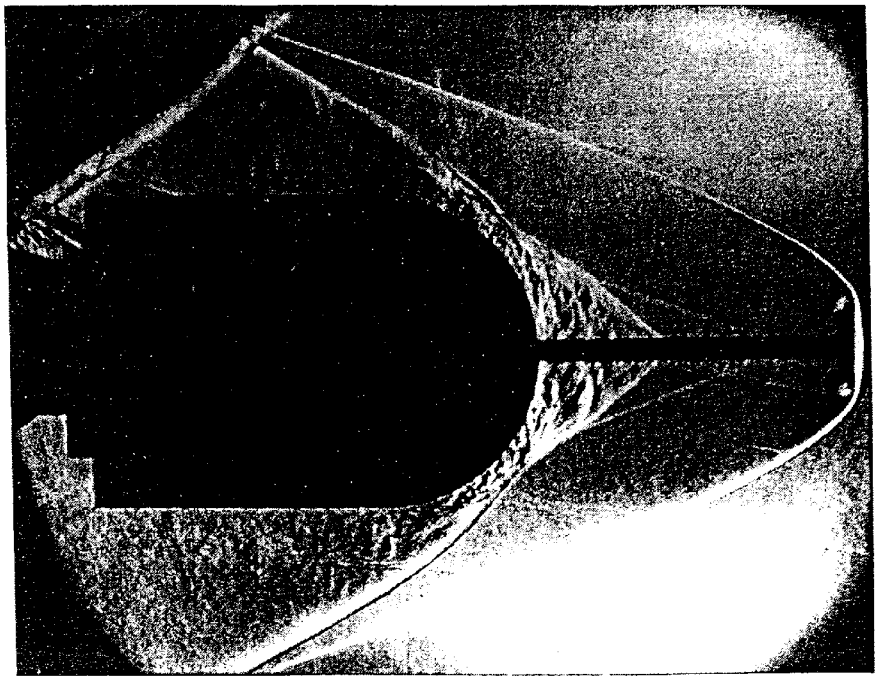
FIG. 3*a* shows the flow around the spike with a conventional plate at 0° angle of incidence.
Figure 3B:
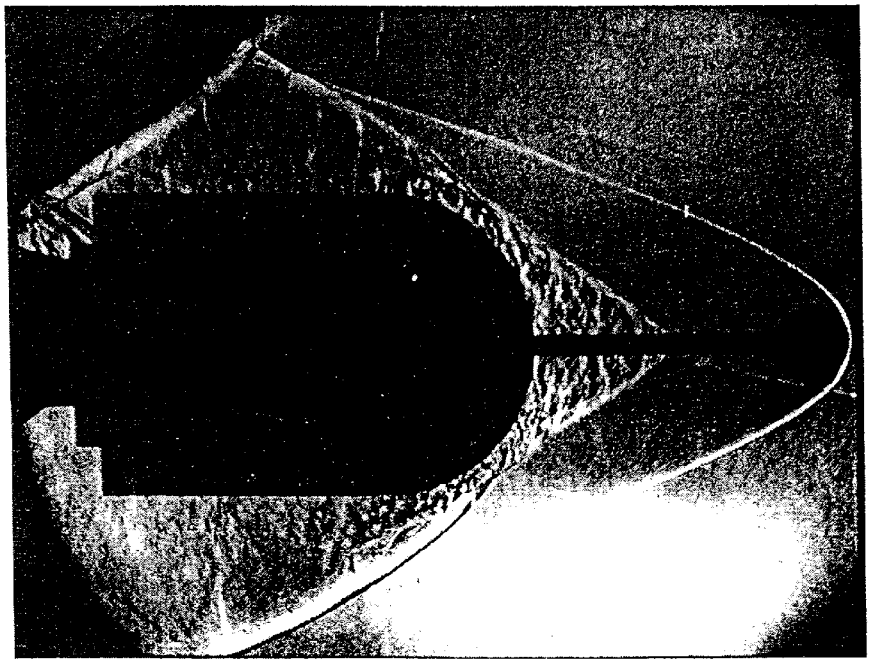
FIG. 3*b* shows the flow around the spike with the mount according to the invention at 0° angle of incidence.

In FIG. 3*a*, the flow around the spike with a plate (aerodisk) is represented according to the state of the art, and in FIG. 3*b*, it is represented with a sphere according to the invention, with an angle of incidence of 0° in each case. A difference in the behavior of the flow can be seen only in the local expansion and separation at the edge of the plate in FIG. 3*a* that has no further influence on the additional behavior of the flow. In both cases, the flow separates at approximately ⅔ of the spike length measured from the plate or sphere. The released flow mixes the following flow that is generated by the compression wave that proceeds from the plate or sphere. This flow brings about the intended reduction of pressure and temperature on the hemispherical nose. The released flow can be clearly identified by the highly visible fluctuations in density.

Figure 4A:
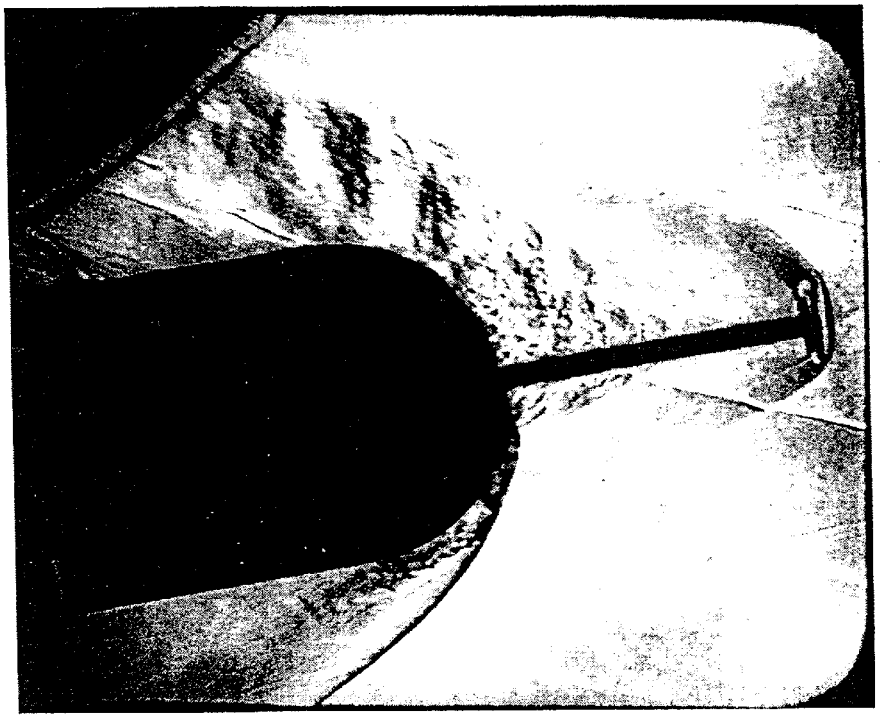
FIG. 4*a* shows the flow around the spike with a conventional plate at 10° angle of incidence.
Figure 4B:
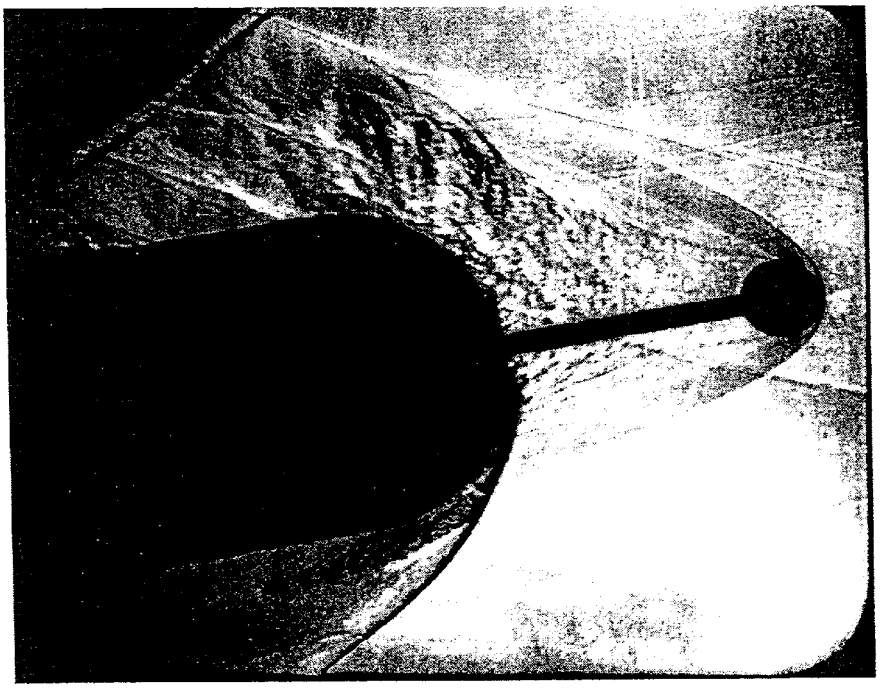
FIG. 4*b* shows the flow around the spike with the mount according to the invention at 10° angle of incidence.

In FIGS. 4*a* and 4*b*, the flow is represented with the same Mach number but at an angle of incidence of 10° at the spike with the same length, and the plate or sphere has the same diameter. A clear difference in the surrounding flow can be seen between the plate in FIG. 4*a* and sphere in FIG. 4*b*. In both cases, the flow separates immediately, but whereas the flow released from the conventional plate in FIG. 4*a* advances nearly to the lee side (downwash side), and nearly the entire external flow on the windward side contacts the hemispherical nose (which can be clearly seen on the mesh lines) with a corresponding increase in temperature and pressure, completely different flow behavior can be seen with the sphere according to the invention in FIG. 4*b*.

A compression wave forms initially as expected, but it is immediately weakened by an expansion fan. After the expansion fan, the flow separates from the sphere. This released flow mixes with the flow following the attenuating fan and contacts the downwash and windward sides when it is deflected. It contacts the entire hemispherical nose, almost all of which experiences a reduction in pressure and hence resistance and temperature.

It has subsequently been revealed that the described phenomenon occurs even at large angles of incidence of 17–18°.

Figure 2A:
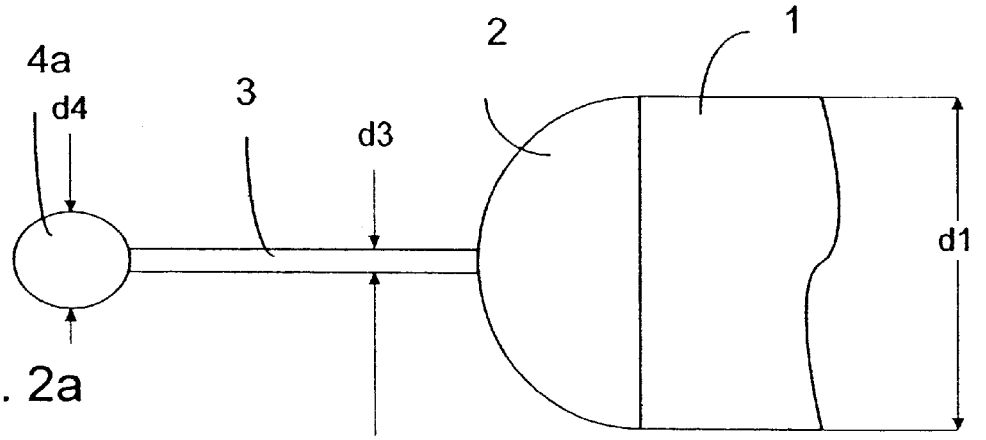
FIG. 2*a* is a schematic representation of a variation of the spike mount in an ellipsoidal shape.
Figure 2B:
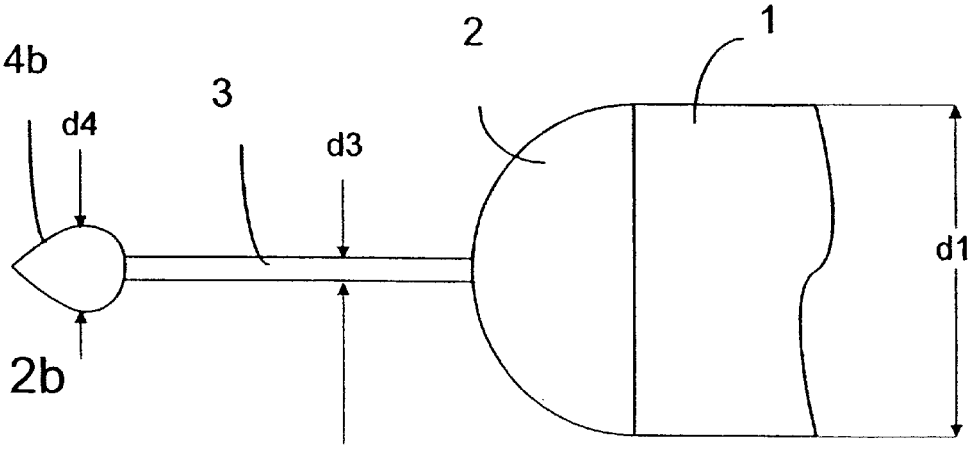
FIG. 2*b* is a schematic representation of a variation of the spike mount in a drop shape.

The same effect arises with ellipsoid or drop-shaped bodies on the spike tip, as shown in FIGS. 2*a* and 2*b*. The explanation for the described phenomenon is essentially that the flow around the front of such a body is independent of the angle of incidence.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A missile comprising:

a missile body having a front tip oriented in a traveling direction of said missile;

an elongate spike having one end mounted on said front tip of said missile body, and aligned with a longitudinal axis thereof; and an additional body fixedly mounted on an opposite end of said spike; wherein the additional body has a shape selected from the group consisting of spherical, ellipsoidal and drop-shaped; and the diameter of the spike is between 50 and 20 percent of the diameter of the additional body.

2. The apparatus according to claim 1, wherein the diameter of the additional body is between 15 and 30 percent of the diameter of the missile body.

3. The missile according to claim 1, wherein:

the additional body has a transverse dimension that is approximately one fourth of a diameter of the missile body.

4. The missile according to claim 3, wherein the spike has a transversed dimension which is much smaller than the diameter of the missile body.

5. The missile according to claim 4, wherein:

the missile body has a diameter of approximately 70 MM;

the additional body has a transverse dimension of approximately 17.5 MM; and the spike has a transverse dimension of approximately 5 MM and a length of approximately 45 MM.

* * * * *